US006018950A

United States Patent [19]

Moeller

[11] Patent Number: 6,018,950

[45] **Date of Patent: *Feb. 1, 2000**

[54] COMBUSTION TURBINE MODULAR COOLING PANEL

[75] Inventor: Scott Michael Moeller, Orlando, Fla.

[73] Assignee: Siemens Westinghouse Power Corporation, Orlando, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/874,703

[22] Filed: Jun. 13, 1997

[51] Int. Cl.[7] ..... F02C 7/12; F23R 3/06

[52] U.S. Cl. ..... 60/752; 60/757; 60/758; 60/760; 29/889.2

[58] Field of Search ..... 60/265, 266, 267, 60/752, 754, 755, 756, 757, 758, 760, 39.37; 29/889.2, 889.22

[56] References Cited

U.S. PATENT DOCUMENTS

| | | | |
|---|---|---|---|
| 2,610,467 | 9/1952 | Miller | 60/757 |
| 2,938,333 | 5/1960 | Wetzler | 60/266 |
| 2,958,194 | 11/1960 | Bayley | 60/760 |
| 3,016,703 | 1/1962 | Lorett et al. | 60/752 |
| 3,186,168 | 6/1965 | Ormerod et al. | 60/752 |
| 3,349,558 | 10/1967 | Smith . | |
| 3,485,043 | 12/1969 | Ehrich | 60/757 |
| 3,572,031 | 3/1971 | Szetela | 60/757 |
| 3,589,128 | 6/1971 | Sweet | 60/757 |
| 3,652,181 | 3/1972 | Wilhelm, Jr. . | |
| 3,702,058 | 11/1972 | De Corso et al. | 60/757 |
| 3,800,864 | 4/1974 | Hauser et al. | 165/47 |
| 3,898,797 | 8/1975 | Wood | 60/756 |
| 4,392,355 | 7/1983 | Verdouw | 60/752 |
| 4,719,748 | 1/1988 | Davis, Jr. et al. | 60/760 |
| 4,821,522 | 4/1989 | Matthews et al. | 60/757 |
| 4,872,312 | 10/1989 | Iizuka et al. | 60/754 |
| 5,144,793 | 9/1992 | Able et al. | 60/757 |
| 5,375,973 | 12/1994 | Sloop et al. | 415/173.1 |
| 5,596,870 | 1/1997 | Dillard et al. | 60/752 |
| 5,647,202 | 7/1997 | Althaus | 60/760 |
| 5,687,572 | 11/1997 | Schrantz et al. | 60/754 |
| 5,737,922 | 4/1998 | Schoenman et al. | 60/752 |

FOREIGN PATENT DOCUMENTS

| | | | |
|---|---|---|---|
| 2087066 | 5/1982 | United Kingdom | 60/266 |
| 2 200 738 | 8/1988 | United Kingdom . | |

OTHER PUBLICATIONS

Office Soviet, N. XP 002081602, Name of Patentee Derwent Publications Ltd., Date: Jan. 1966.

*Primary Examiner*—Ted Kim

*Attorney, Agent, or Firm*—Eckert Seamans Cherin & Mellott, LLC

[57] ABSTRACT

A modular cooling panel for cooling a turbine member is provided. The cooling panel comprises a first panel having a relative width, relative length, upper surface and lower surface. The upper surface defines at least one corrugated portion traversing along a portion of the relative width of the upper surface. The corrugated portion defines a cooling flow channel through which a cooling fluid can travel to cool the turbine member. The cooling flow channel has at least one inlet opening for enabling the cooling fluid to enter into the cooling flow channel. The lower portion surface of the first panel is adapted to be coupled in fluid communication with the turbine member.

16 Claims, 11 Drawing Sheets

COMBUSTION TURBINE MODULAR COOLING PANEL

FIELD OF THE INVENTION

The present invention relates generally to combustion turbines and more particularly to an apparatus for cooling combustor turbine components.

BACKGROUND OF THE INVENTION

Combustion turbines comprise a casing for housing a compressor section, combustor section and turbine section. Each one of these sections comprise an inlet end and an outlet end. A combustor transition member is mechanically coupled between the combustor section outlet end and the turbine section inlet end to direct a working gas from the combustor section into the turbine section. Conventional combustor transition members may be of the solid wall type or interior cooling channel wall type (see FIG. 1). In either design, the combustor transition member is formed from a plurality of metal panels.

The working gas is produced by combusting an air/fuel mixture. A supply of compressed air, originating from the compressor section, is mixed with a fuel supply to create a combustible air/fuel mixture. The air/fuel mixture is combusted in the combustor to produce the high temperature and high pressure working gas. The working gas is ejected into the combustor transition member to change the working gas flow exiting the combustor from a generally cylindrical flow to an generally annular flow which is, in turn, directed into the first stage of the turbine section.

As those skilled in the art are aware, the maximum power output of a gas turbine is achieved by heating the gas flowing through the combustion section to as high a temperature as is feasible. The hot working gas, however, may produce combustor section and turbine section component metal temperatures that exceed the maximum operating rating of the alloys from which the combustor section and turbine section are made and, in turn, induce premature stress and cracking along various turbomachinary components, such as a combustor transition member.

Several prior art apparatus have been developed to cool combustor transition members. Some of these apparatus include impingement plates, baffles, and cooling sleeves spaced about the combustor transition member outer surface. These apparatus, however, have several drawbacks.

One drawback with these prior art cooling apparatus is that each type of cooling apparatus can only be employed with a specific transition member. If one owns combustion turbines that require various types of transition members, then an inventory of various types of cooling apparatus are required for maintenance purposes. It would, therefore, be desirable to provide a cooling apparatus that can be employed with more than one type of transition member.

Other conventional methods have been developed to overcome the need for separate apparatus for cooling a transition. FIG. 1, which shows one of these methods, is a transition member 20 having a sidewall 22 that defines an interior working gas flow channel 24. The interior working gas flow channel has an inlet end 26 and exit end 28. The sidewall 22 comprises a plurality of interior cooling flow channels 30, cooling air entrance holes 32 and cooling air exit holes 35. The transition member 20 is cooled by a cooling fluid that enters the cooling air entrance holes 32, travels through the interior cooling flow channels 30, exits past the exit holes 35, and, in turn, enters into the working gas flow channel 24.

The transition member 20 is manufactured from a plurality of panels 34 that define the interior cooling flow channels 30 and cooling air exit holes 35, as shown in FIG. 2. The panels 34 are made from a first metal plate 36 and second metal plate 38. The interior cooling flow channels 30 are formed by attaching the first metal plate 36 and second metal plate 38 together. The first metal plate 36 is formed with a plurality of grooves 40 that extend along a relative longitudinal direction for substantially the entire length of the first plate 36. The exit holes 35 are formed in the first plate 36 in fluid communication with at least one groove 40. The second plate 38 is formed with the cooling flow entrance holes 32 which are in fluid communication with the grooves 40 After attaching the first 36 and second panels 38 together, a plurality of cooling panels are formed into the desired shape to form a particular transition member. Transition members 20 made from these panels 34, however, have several drawbacks.

One drawback of employing this type of transition member 20 is that they commonly fail at a relatively small area along the interior cooling flow channel 30. The area that fails cannot be repaired or replaced and, therefore, the entire transition member 20 must be replaced. The replacement of an entire transition member 20 is relatively costly. It would, therefore, be desirable to provide a transition member that allows for the replacement of less than the entire transition member after the transition member has suffered less than an entire failure.

SUMMARY OF THE INVENTION

A cooling panel for cooling a turbine member is provided. The cooling panel comprises a first panel having a relative width, length, upper surface and lower surface. The upper surface defines at least one corrugated portion traversing along a portion of the relative width of the upper surface. The corrugated portion defines a cooling flow channel through which a cooling fluid can travel to cool the turbine member. The cooling flow channel has at least one inlet opening for enabling the cooling fluid to enter into the cooling flow channel. The first panel is adapted to be coupled in fluid communication with the working fluid.

DETAILED DESCRIPTION OF THE PREFERRED EMBODIMENTS

Figure 3:
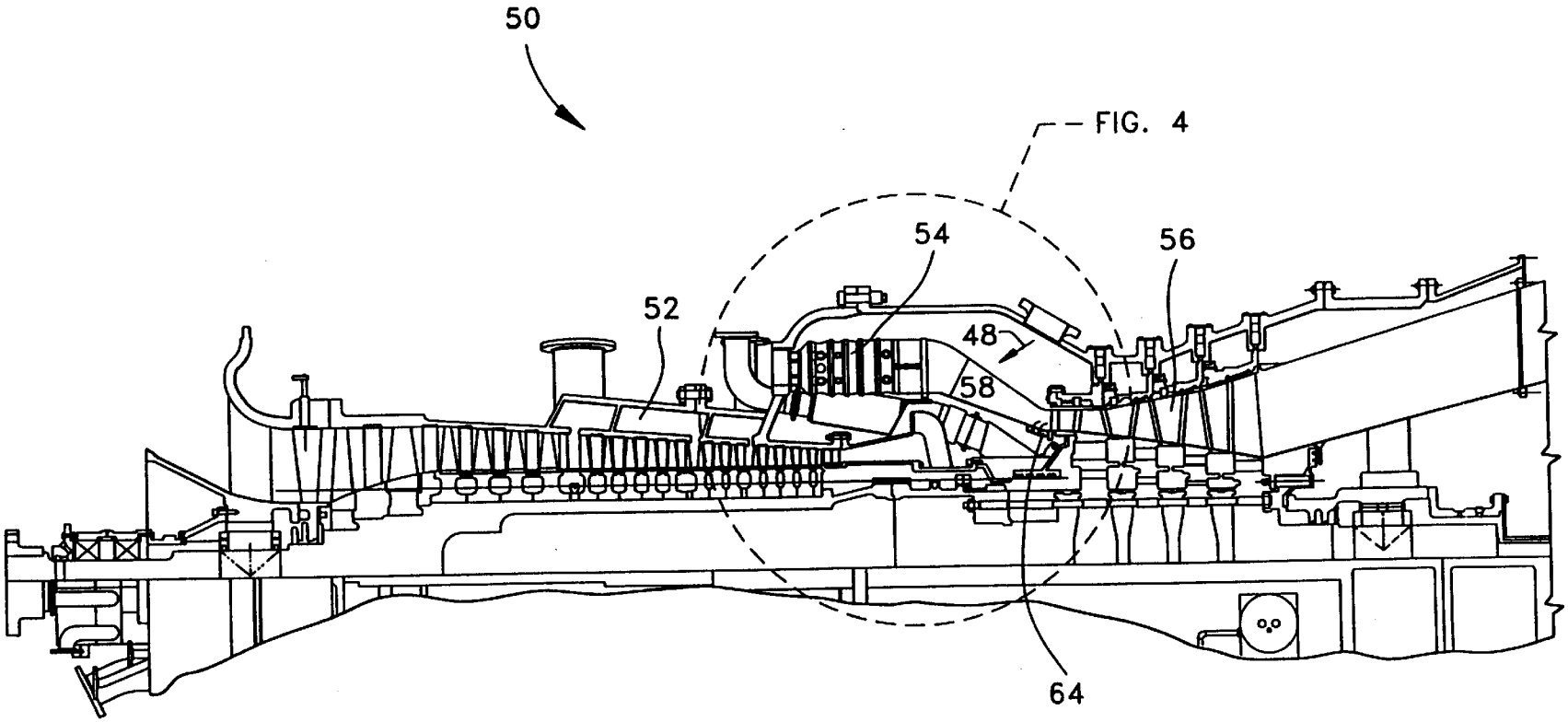
FIG. 3 is a sectional-view of a combustion turbine in accordance with the present invention.

Referring to the drawings, wherein like reference numerals designate corresponding structure throughout the views, and in particular to FIG. 3, a gas turbine 50 of the type employing the present invention is shown. The gas turbine 50 comprises a combustor shell 48, compressor section 52, combustor section 54, and a turbine section 56.

Figure 4:
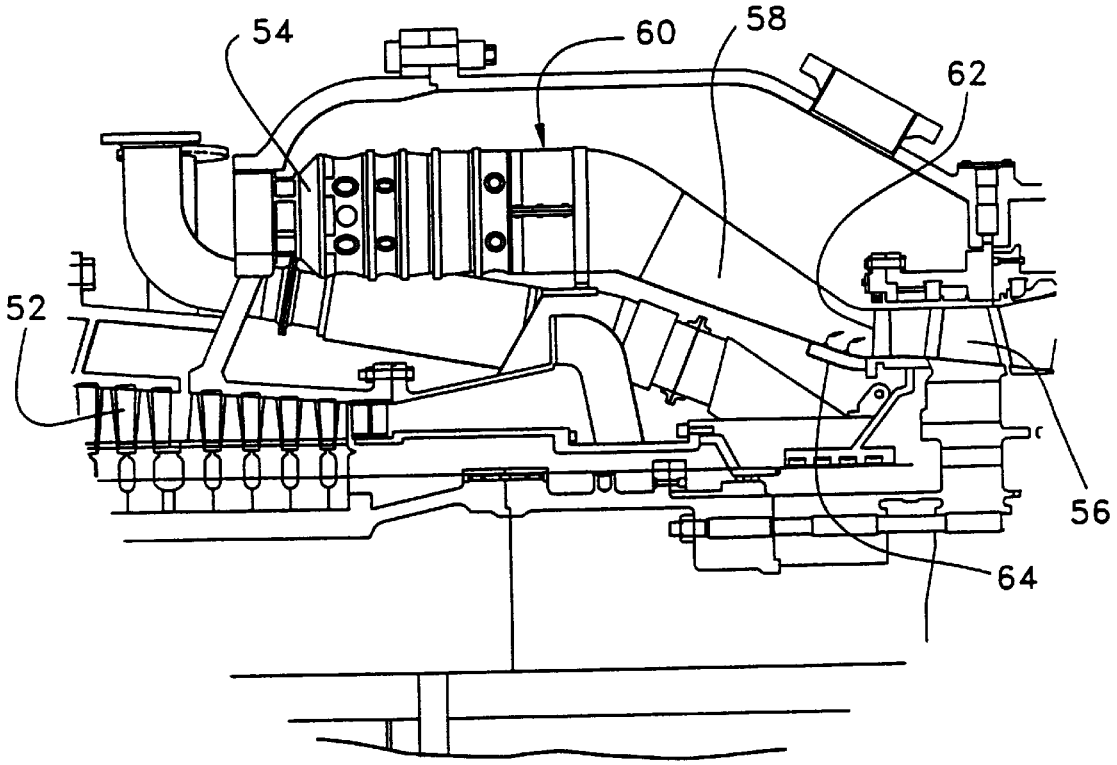
FIG. 4 is an enlarged view of a section of the compressor, combustor, transition member, cooling panel and turbine shown in FIG. 3.

Referring to FIG. 4, the air compressor 52, combustor 54, and a portion of the combustor shell 48 and turbine 56 are shown. Additionally, a conventional solid wall type transition member 58 is coupled at its inlet end 60 to the combustor 54, and at its exit end 62 to the first stage of the turbine 56.

In accordance with one aspect of the present invention, a cooling panel 64 is provided to cool a portion of the transition member 58. The conventional transition member 58 is adapted or retrofitted to be mechanically coupled with the cooling panel 64. The preferred modifications made to the conventional transition member 58 are discussed in more detail below. It is noted that although the following description refers to the application of the cooling panel 64 to a solid wall type transition member 58, the cooling panel 64 may be employed to cool other types of transition members and turbine members if these types of apparatus are changed to comprise a solid panel.

Figure 5:
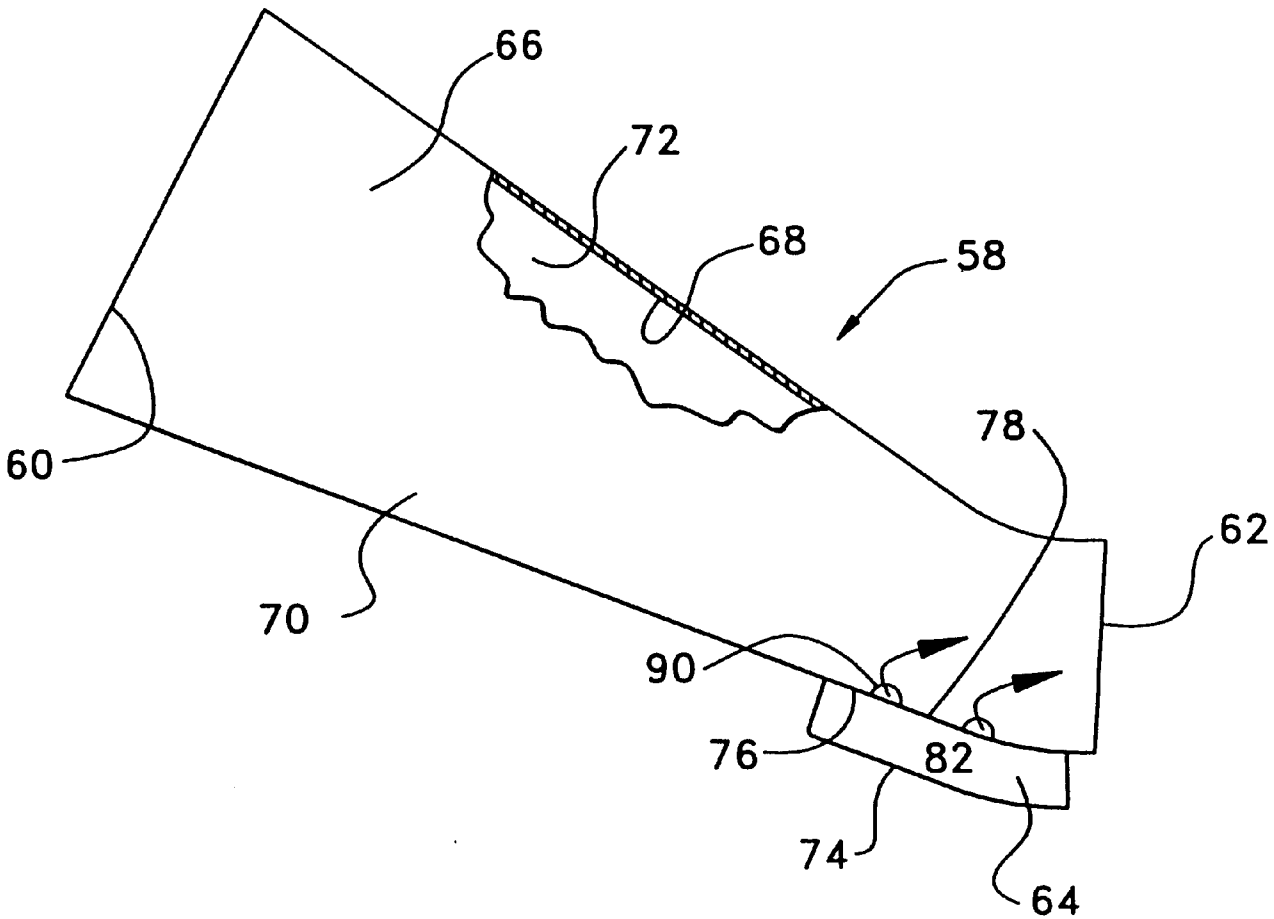
FIG. 5 is a partial cut-out view of the transition member and cooling panel shown in FIG. 4.

Referring to FIG. 5, the transition member 58 and cooling panel 64 are shown in more detail. The transition member 58 comprises a sidewall 66 having an interior surface 68 and exterior surface 70. The interior surface 68 defines a working gas flow channel 72. The working gas flow channel 72 extends from the inlet opening 60 to the exit opening 62. The transition member 58 is retrofitted with cooling flow inlet holes 90. Each inlet hole 90 extends to the interior surface 68 of the transition member 58 such that each cooling panel 64 is in fluid communication with the working gas flow channel 72. The cooling flow inlet holes 90 are discussed in more detail below.

The cooling panel 64 has a relative outer surface 74 and relative inner surface 76. The relative inner surface 76 of the cooling panel 64 is mechanically coupled adjacent to a lower portion 78 of the exterior surface 70 of the transition member 58 proximate to the transition member exit opening 62. In this arrangement, the exterior surface 70 of the transition member 58 and cooling panel 64 are exposed to the relatively cool air discharged from the compressor section 52 and directed by the combustor shell 48. It is noted that the number and placement of the cooling panels 64 may vary depending on the desired cooling requirements of a particular transition member, as will be understood by those familiar with such particular transition members. A more detailed discussion of how the transition member 58 and cooling panel 64 are coupled is provided below.

Figure 6:
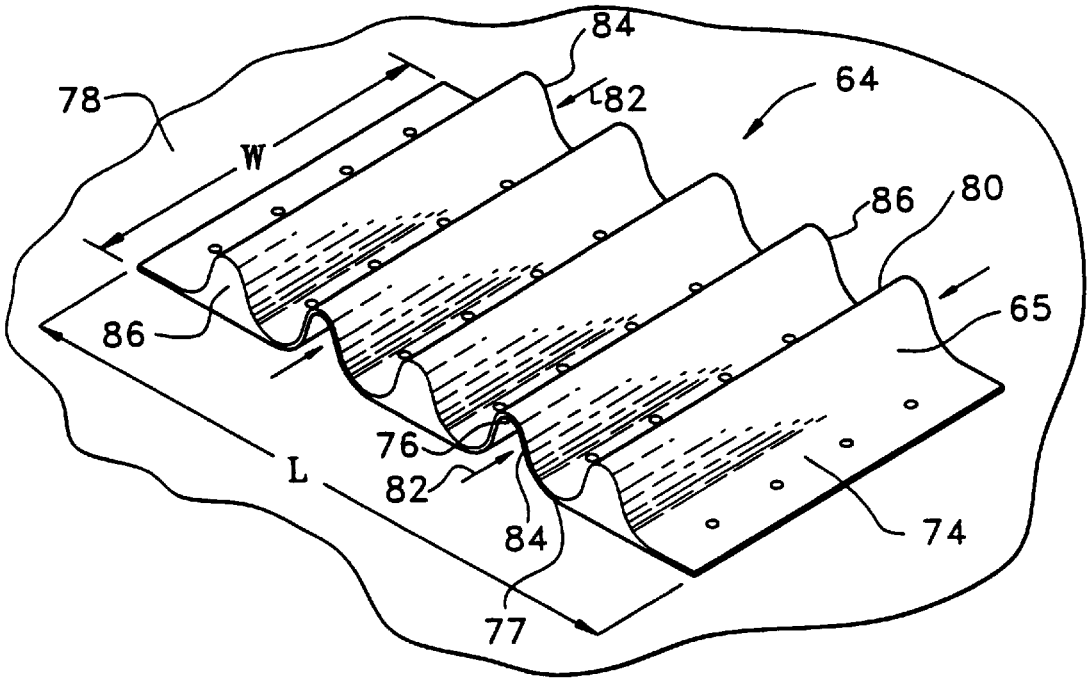
FIG. 6 is a perspective view of the cooling panel shown in FIG. 5.

FIG. 6 shows the cooling panel 64 in more detail. The cooling panel 64 is made from a first metal panel 65 that has a relative length L and relative width W. These dimensions may vary from cooling panel to cooling panel 64 depending on what type of transition member or portion of a transition member that may be cooled. Preferably, each cooling panel 64 defines a plurality of corrugations 80 that traverse the entire width W of the cooling panel 64. Each corrugation 80 defines a cooling flow channel 82 along the relative inner surface 76 of the cooling panel 64. It is noted that a cooling panel 64 can define a single corrugation 80 with a cooling flow channel 82. In this case, one or a series of cooling panels having a single cooling flow channel 82 may be aligned to perform the same functions as a cooling panel having a plurality of cooling flow channels.

Preferably, each cooling flow channel 82 has an open end 84 and an opposing closed end 86. This arrangement alternates from one cooling flow channel 82 to the next adjacent cooling flow channel 82. The open end 84 is adapted to direct the cooling fluid from combustor shell 48 into the cooling flow channel 82. The closed end 86 is formed during the forming of the panel 64. A stamping method may be employed to form each cooling panel 64 with corrugations 80, Types of material that are employed to manufacture cooling panels 64 include Hastelloy X, IN-617, and Haynes 230.

Figure 7:
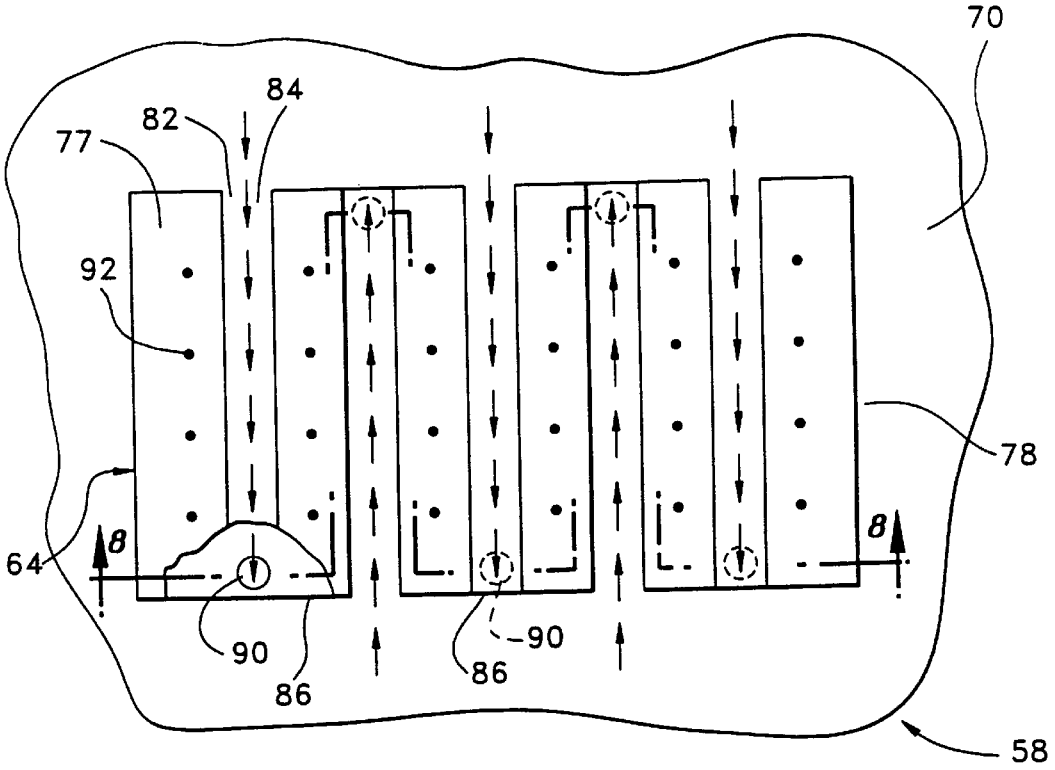
FIG. 7 is a frontal view of the cooling panel shown in FIG. 6.

Referring to FIG. 7, the cooling panel 64 is shown coupled adjacent to the lower portion 78 of the exterior surface 70 of the transition member 58 proximate the transition member exit opening 62. The transition member, 58 is retrofitted so the cooling panel 64 can be employed to cool a portion of the transition member 58. To retrofit the transition member 58, a plurality of cooling flow exit holes 90 are formed through the lower portion 78 of the transition member 58 at relative locations where corresponding cooling flow channels 82 will be aligned once the cooling panel 64 is coupled with the transition member 58.

Preferably, only one cooling flow exit hole 90 is provided in the transition member 58 per each cooling flow channel 82 at relative locations proximate to the closed end 86 of the cooling flow channel 82. As shown, five cooling flow channels 82 are formed in the cooling panel 64, therefore, five cooling flow exit holes 90 are formed in the transition member 58 at relative locations proximate to the closed end 86 of each cooling flow channel 82. It is noted that multiple cooling flow exit holes 90 can be provided in the transition member for each cooling flow channel 82.

Preferably, the periphery of each cooling panel 64 is fillet welded to the lower portion 78 of the exterior surface 70 of the transition member 58. Additionally, the attaching surface 77 of the cooling panel 64 may be spot welded 92 to the transition member 58. Additionally, the attaching surface 77 that extends between the full length of each cooling flow channel 82 is welded to the transition member to provide a seal between each cooling flow channel 82 to prevent cooling air from leaking into adjacent cooling flow channels 82. Methods or techniques of providing this seal include tig welding and laser welding.

Figure 8:
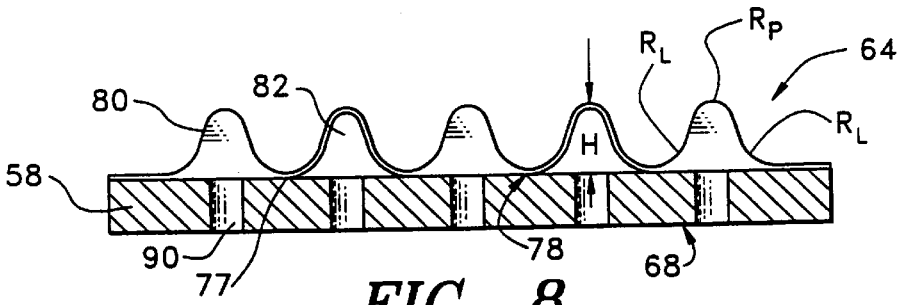
FIG. 8 is a partial cut-out planar view of the cooling panel shown in FIG. 6.

Referring to FIG. 8, preferably, all of the corrugations 80 that are formed on a single cooling panel 64 have substantially the same geometric shape and same dimensions, and are spaced equidistantly apart from each neighboring corrugation 80. Preferably, each corrugation 80 comprises a relative height H with a peak radius $R_P$, two leg radii $R_L$, and a longitudinal axis L. The peak radius $R_P$ blends smoothly with each one of the leg radii $R_L$. Each leg radii $R_L$ extends into and blends smoothly with a corresponding attaching surface 77. It is noted that the corrugation 80 may be of other geometric shapes and sizes and in various combinations of shapes and sizes depending upon the desired cooling requirements. The relative bottom of each attaching surface 77 is adapted to be mechanically coupled with the transition member 58.

The preferred dimensions of each one of the corrugations 80 are listed below. The relative height H of each corrugation 80 is approximately 0.150 inches. Each peak radius $R_P$ is approximately 0.050 inches. Each leg radii $R_L$ is approximately 0.10 inches. The attaching surface 77 extends between each corrugation 80 for approximately 0.200 inches. The distance between each neighboring longitudinal axis is approximately 0.500 inches.

Figure 1:
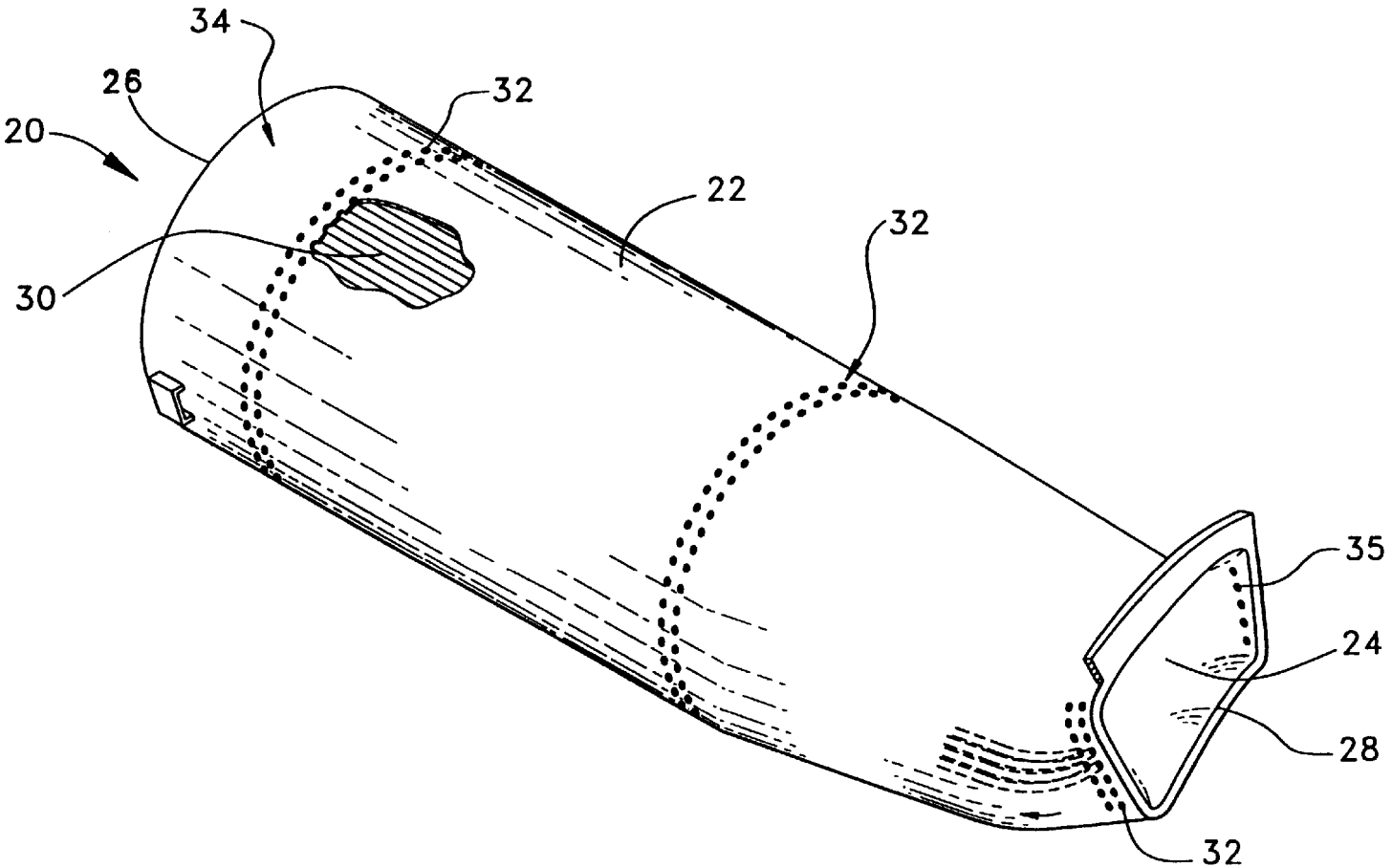
FIG. 1 (PRIOR ART)
FIG. 1 is a partial cut-out view of a prior art transition member.
Figure 2:
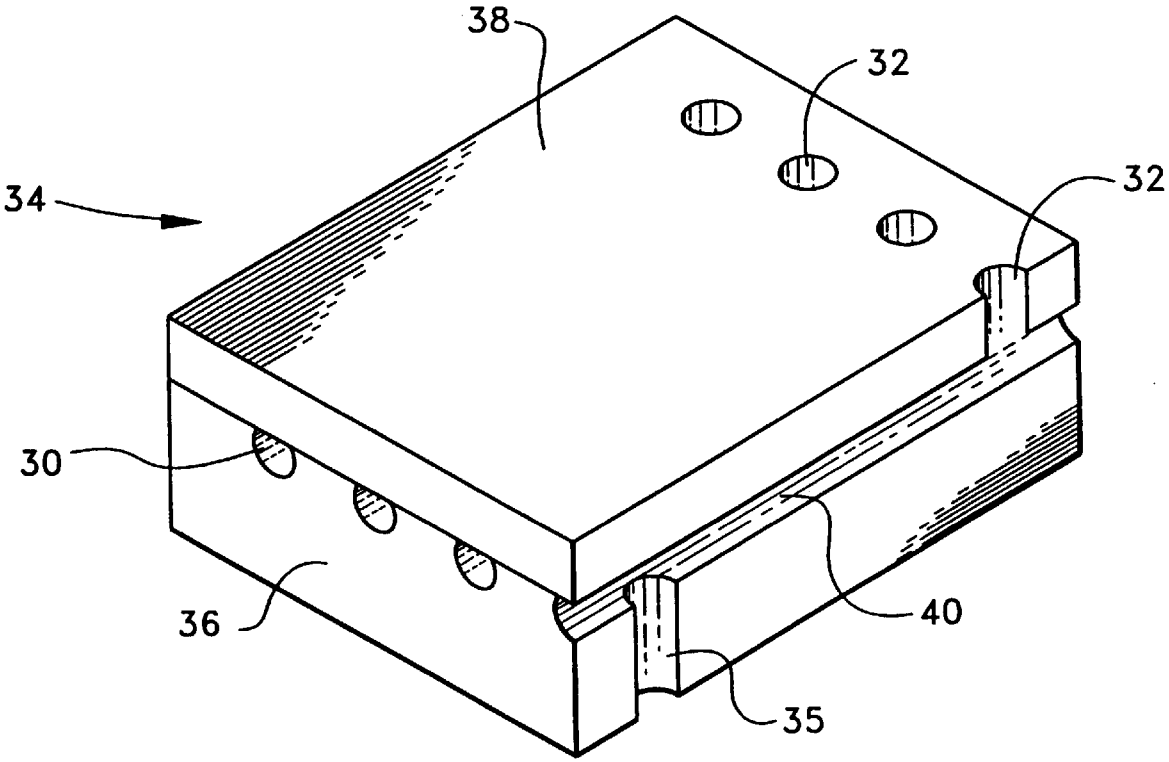
FIG. 2 (PRIOR ART)
FIG. 2 is a partial cut-out view of a cooling panel employed to manufacture the transition member shown in FIG. 1.

As an improvement over the prior art transition member shown in FIG. 1, a single cooling panel 64 that has suffered either a partial or full failure can be replaced without having to replace the entire transition member 58. Each cooling panel 64 is adapted to be removed by any known method and replaced with another cooling panel 64. Such removing methods include grinding or filing down all of the corrugated surfaces 80 formed on a particular cooling panel 64 until the transition member 58 exterior surface 70 is reached. Upon reaching the exterior surface 70, another cooling panel 64 is coupled to that area of the transition member 58 by the methods discussed above.

The cooling panel 64 may also be employed to cool other types of transition members after the transition members have been retrofitted in the same or similar manner as the solid wall transition member. The size and number of cooling panels that are required to adequately cool these conventional transition members may vary with transition member design. Additionally, the cooling panel 64 may be coupled at different locations to cool various parts of a transition member.

The cooling panel 64 in accordance with the present invention will be described in operation with a solid wall type transition member 58. The exterior surface 68 of the transition member 58 is convectively cooled by compressed air in the combustor shell 48 flowing from the compressor section 52 toward the combustor 54. A portion of the exterior surface 70 of the transition member 58 is disposed in the direct flow of the compressed air as it changes direction after exiting the compressor section 52. The lower portion 78 of the exterior surface 70 proximate to the turbine section 56 is coupled with the cooling panel 64. The cooling panel 64 is coupled to the transition member 58 such that the cooling flow channels 82 are in fluid communication with the cooling flow exit holes 90 formed in the transition member 58 and combustor shell air 48. The compressed air exiting the compressor section 52 enters the open end 84 of the cooling panel flow channel 82 and travels through the cooling flow channels 82 while removing heat from the transition member 58. The air then travels through the cooling flow exit hole 90 formed in the transition member 58 until reaching the working gas flow channel 72. The air is then mixed in with the working gas and directed into the turbine section 56.

Figure 9:
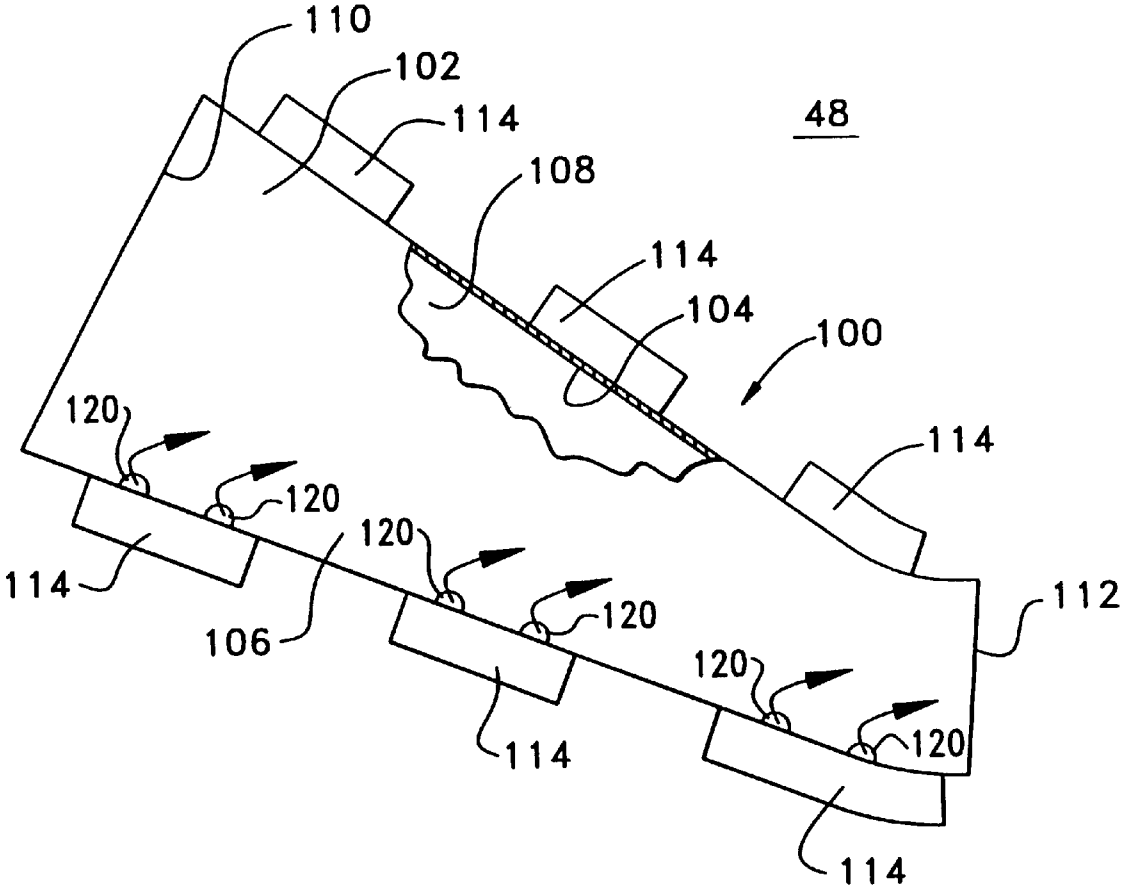
FIG. 9 is a partial cut-out view of a transition member according to another aspect of the invention.

Referring to FIG. 9, an improved transition member 100 in accordance with another aspect of the present invention is provided. The transition member 100 comprises a sidewall 102 having an interior surface 104 and exterior surface 106. The interior surface 104 defines an interior working gas flow channel 108 having an inlet opening 110 and exit opening 112. The inlet opening 110 is adapted to be mechanically coupled with a combustor 54, and the exit opening 112 is adapted to be coupled to the first stage of a turbine 56.

The exterior surface 106 of the sidewall 102 defines a plurality of cooling flow channels 114 that are in fluid communication with the working gas flow channel 108. The cooling channels 114 are provided at locations proximate to those areas of the transition member 100 that may be cooled during the operation of the combustion turbine.

A plurality of cooling flow inlet holes 120 are formed through the sidewall 102 at relative locations where corresponding cooling flow channels 114 are aligned. Each inlet hole 120 extends to the interior surface 104 of the transition member 100 such that the cooling flow channels 114 are in fluid communication with the transition member working gas flow channel 108 and combustor shell air 48.

Figure 10:
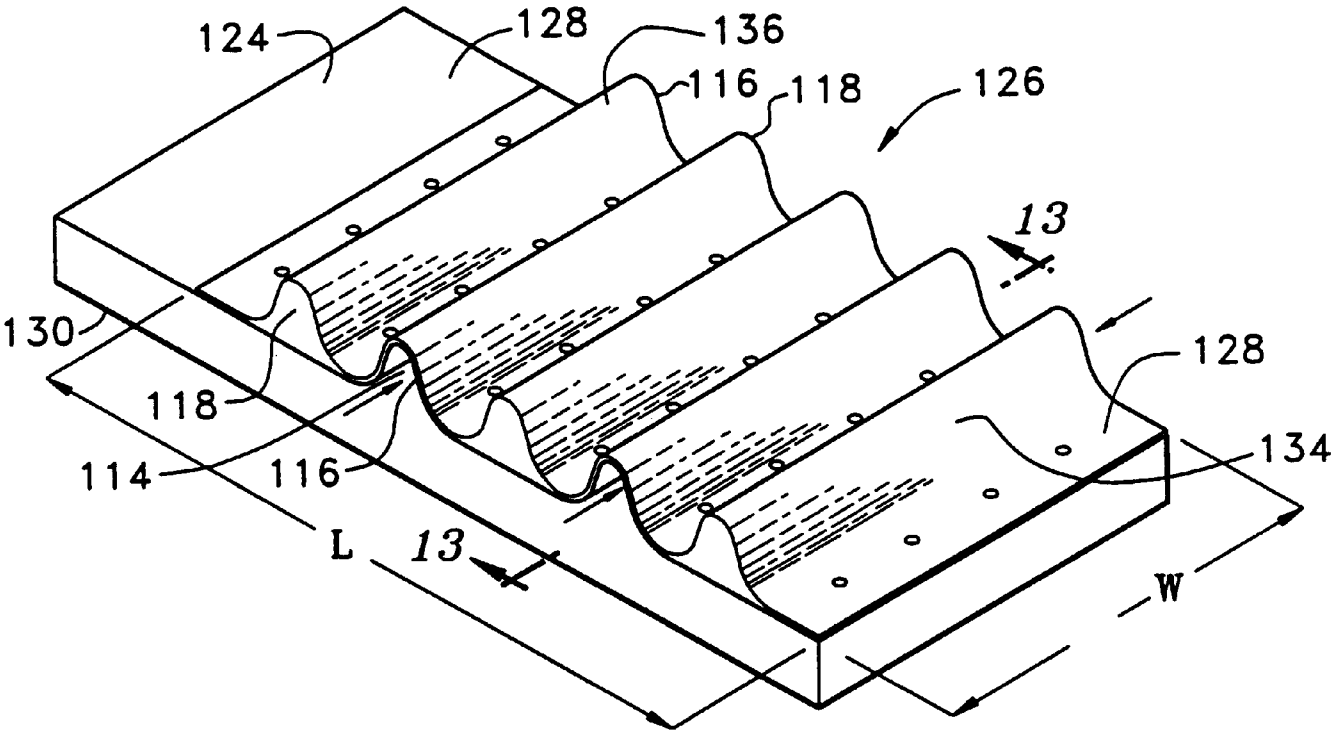
FIG. 10 is a perspective view of a cooling panel and metal panel employed to manufacture the transition member shown in FIG. 9.

The sidewall 102 is made up of a plurality of metal panels 124 and cooling panels 126, as shown in FIG. 10. The metal panels 124 and cooling panels 126 are coupled together such that they form the desired transition member 100. Conventional methods of coupling metal panels to form conventional transition members may be employed to coupled the metal panels 124 and cooling panels 126 to form the transition member 100.

After all of the metal panels 124 and cooling panels 126 have been coupled, all of the metal panels 124 and cooling panels 126 define the working gas flow channel 108. The placement of each metal panel 124 and cooling panel 126 to form the transition 100 may vary depending on what size transition member is desired and the area of the transition member that may be cooled. The metal panel 124 can be manufactured from materials and methods employed for forming conventional transition members. Such materials include IN-617, Haynes 230, and Hastelloy X. One method of forming the transition member includes stamping methods.

Preferably, each one of the cooling panels 126 has a plurality of corrugations 136 that traverse along the relative width W of an outer metal sheet 134 to form each cooling flow channel 114. Preferably, all of the corrugations 136 that are formed on a single outer metal sheet 134 have substantially the same geometric shape and same dimensions as the corrugations 80 discussed above. Each cooling flow channel 114 has an open end 116 and an opposing closed end 118. This arrangement alternates from one cooling flow channel 114 to the next cooling flow channel 114. The open end 116 is adapted to direct the cooling fluid from the combustor shell 48 into the cooling flow channel 114.

Figure 11:
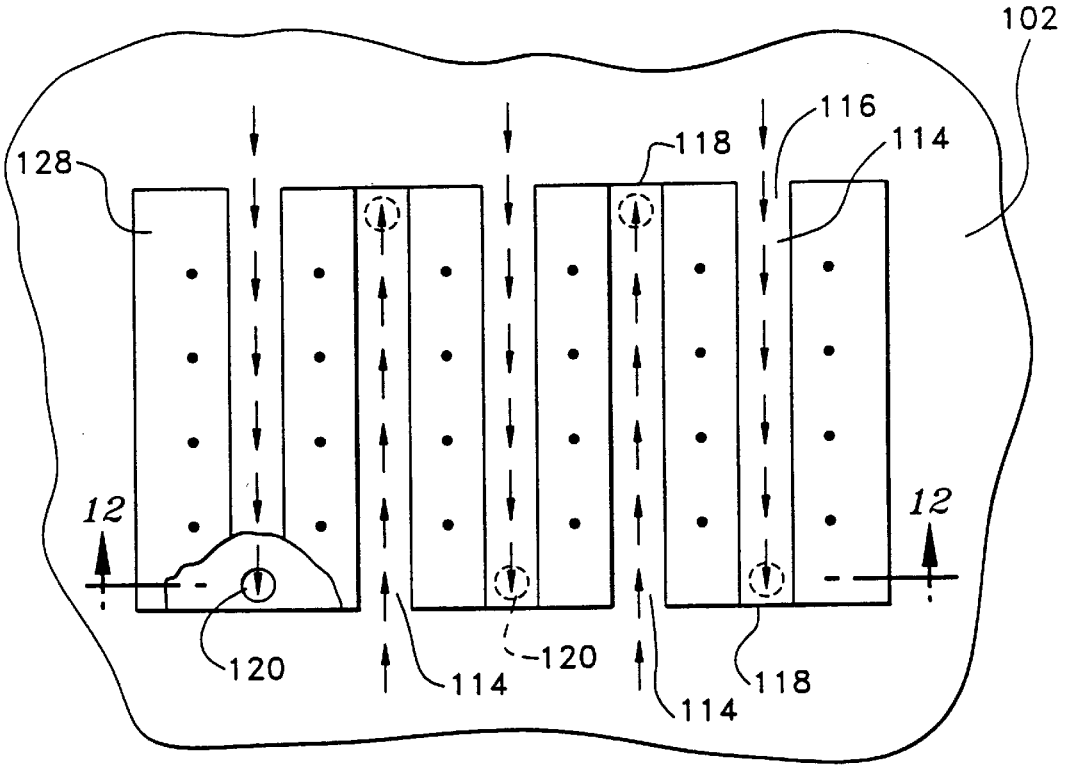
FIG. 11 is a partial cut-out planar view of the cooling panel shown in FIG. 10.

Referring to FIG. 11, preferably, only one cooling flow exit hole 120 is provided per each cooling flow channel 114 at a relative location proximate to the closed end 118 of the cooling flow channel 114.

Figure 12:
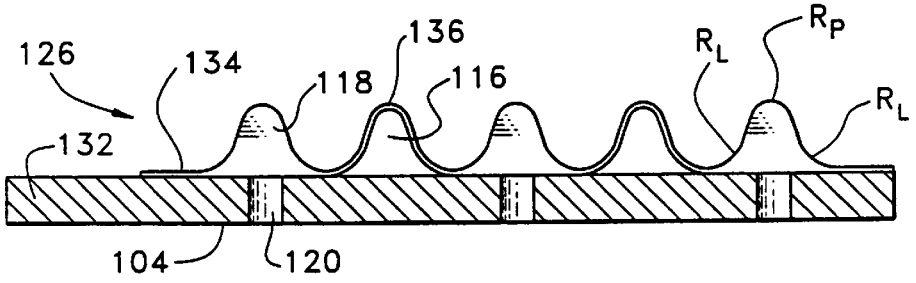
FIG. 12 is a frontal view of the cooling panel and metal panel shown in FIG. 10.
Figure 13:
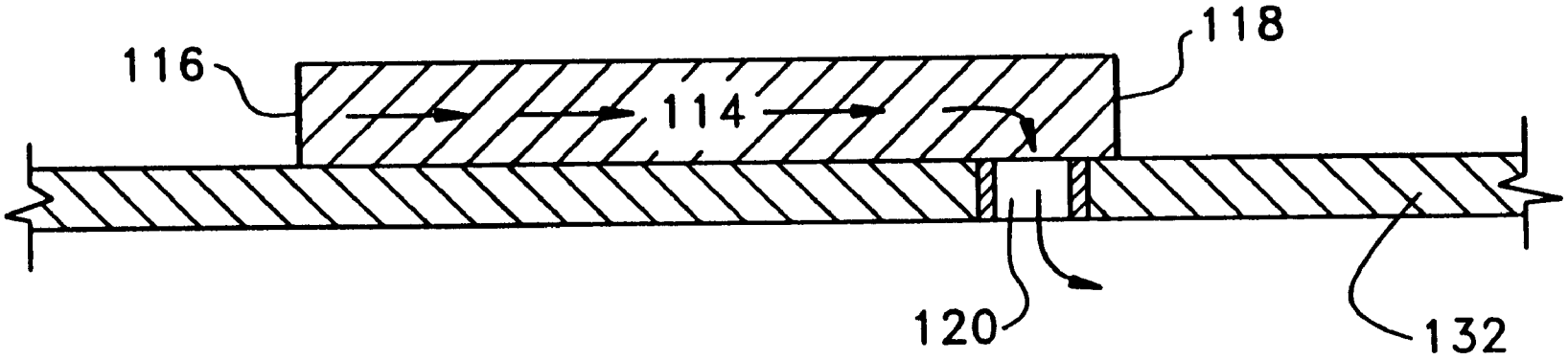
FIG. 13 is a sectional view taken along section line 13—13 in FIG. 10.

Referring to FIGS. 12 and 13, preferably, each one of the cooling panels 126 is made of a relative inner metal sheet 132 and relative outer metal sheet 134. The relative inner metal sheet 132 becomes the interior surface 104 of the completed transition member 100 after the metal panels 124 and cooling panels 126 are coupled. The relative inner metal sheet 132 also defines the cooling fluid exit holes 120. Methods of coupling these sheets 132 and 134 are well known in the art. One method includes the welding techniques discussed above.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A cooling panel for a gas turbine for enhancing cooling of a segment of a turbine member having a wall with an inner and outer surface, where in operation of the turbine the inner surface of the wall houses a working gas that travels along an axial dimension of the turbine member defining its length, which is perpendicular to its width, said cooling panel comprising:

a first modular cooling panel having a relative width (W) and Length (L), which are substantially less than a corresponding dimension of the turbine member wall measured along the same line of measurement of the dimension of the cooling panel when the panel is positioned on the turbine member wall, an outer surface and an inner surface, said inner surface of the cooling panel defining at least one channeled portion traversing along a portion of the inner surface of the cooling panel, said channeled portion defining a cooling flow channel through which a cooling fluid can travel to cool the segment of the turbine member, said cooling flow channel having at least one inlet opening extending into the inner surface of the cooling panel for enabling the cooling fluid to enter into the cooling flow channel from a cooling gas plenum in the turbine that extends over at least a portion of the turbine member's wall, said inner surface of the cooling panel having a portion thereof adapted to be removably attached to the outer surface of the turbine member wall in a manner that does not obstruct the inlet opening from being in fluid communication with the cooling gas plenum, and the cooling panel having a closed end, spaced along said cooling flow channel from said inlet opening, to direct the cooling fluid to an outlet opening which is machined through the turbine member's wall and aligned with the cooling channel to permit the cooling fluid to be in fluid communication with the inner surface of the turbine member wall, the first cooling panel being capable of being replaced without materially affecting or requiring disassembly of the wall or requiring the dismantling of any other cooling panel affixed to the outer surface of the wall.

2. The cooling panel in claim 1, further comprising a plurality of parallel adjacent channels.

3. The cooling panel in claim 2, wherein said plurality of channels are formed from a corrugation.

4. The cooling panel in claim 2, wherein the inlet opening and closed end of one channel are located at opposite ends from the corresponding inlet opening and closed end of the adjacent channel.

5. The cooling panel in claim 2, wherein each channel comprises a relative peak radius ($R_P$) and two leg radii ($R_L$), said peak radius ($R_P$) blending substantially smoothly with each one of said leg radii ($R_L$).

6. The cooling panel in claim 5, wherein each channel is spaced equidistant apart from each neighboring channel.

7. The cooling panel in claim 5, wherein each leg radii ($R_L$) extends into and blends generally smoothly with corresponding generally flat surface, said generally flat surface having an upper portion and bottom portion of each generally flat surface adapted to be removably attached to the turbine member.

8. The cooling panel in claim 1 wherein the inner surface of the cooling panel defines three sides or approximately three quarters of the circumference of the cooling flow channel and the remaining quarter is formed by the outer surface of the wall.

9. The cooling panel of claim 1 wherein the turbine member wall is a structural load bearing component of the turbine member and the modular cooling panel is not a load bearing component.

10. An improved gas turbine having a combustor transition member comprising:

a side wall having an exterior surface and interior surface, said interior surface defining a working gas flow channel having an inlet end and outlet end; and at least one cooling panel having a finite dimension along the exterior surface of the side wall which is substantially less than the corresponding dimension of the side wall measured along the same line as the dimension on the cooling panel when the cooling panel is positioned on the side wall, said cooling panel comprising at least one channel which protrudes in a outwardly direction relative to said exterior surface of said side wall and defines a cooling flow channel having an open end which forms a cooling fluid inlet, adapted to be in fluid communication with a cooling gas plenum that extends over the side wall, and a closed end at an opposite end of the cooling flow channel spaced from the open end, said cooling panel mechanically coupled to said exterior surface of said side wall in a manner that can be removed and replaced without materially damaging the exterior surface of the side wall, or requiring disassembly of the side wall or any other cooling panel, and positioned such that said cooling flow channel is aligned with and in fluid communication with said working gas flow channel through an inlet port in the side wall positioned proximate said closed end.

11. A method of enhancing the cooling properties of a portion of a cooling fluid flow path within a gas turbine transition member enclosed within a shell that surrounds a transition member wall that funnels a working gas to a turbine section to produce mechanical work, wherein the area between the shell and an outer surface on the wall defines the cooling fluid flow path, and the working gas travels within the wall along an axial dimension of the transition member defining its length, which is perpendicular to its width, comprising the steps of:

machining a predetermined sized wall port through the surface of the wall, that provides a cooling fluid flow path between the shell and the interior of the wall;

positioning a discrete cooling panel on the outer surface of the wall, the cooling panel having a channeled portion that defines an elongated coolant flow channel with a cooling fluid inlet port at one end and a closed end spaced from the inlet port, and the cooling panel occupying an area on the outer surface of the wall that has a width and length which is substantially less than the corresponding dimension of the wall;

aligning a portion of the cooling flow channel proximate the closed end with the wall port and the rest of the cooling flow channel with a portion of the surface of the wall to be cooled to form a heat transfer path between the surface of the wall and the cooling fluid; and fastening the cooling panel to the surface of the wall in a manner that enables the cooling panel to be replaced without materially affecting or requiring disassembly of the wall or requiring the dismantling of any other cooling panel affixed to the outer surface of the wall.

12. The method of claim 11 wherein a length of the cooling flow channel is a relatively small increment of the length of the transition.

13. The method of claim 11 wherein the cooling panel defines a plurality of distinct parallel cooling flow channels.

14. The method of claim 13 wherein adjacent parallel cooling flow channels direct the cooling fluid in opposite directions.

15. The method of claim 11 including the step of attaching a plurality of cooling panels to the turbine transition member.

16. The method of claim 15 including the step of removing one cooling panel from the surface of the liner and replacing the one cooling panel with a second cooling panel.

* * * * *